US008973295B2

(12) United States Patent
Ayler

(10) Patent No.: US 8,973,295 B2
(45) Date of Patent: Mar. 10, 2015

(54) TRIGGER MECHANISM

(71) Applicant: Jason Daniel Ayler, Tucson, AZ (US)

(72) Inventor: Jason Daniel Ayler, Tucson, AZ (US)

( * ) Notice: Subject to any disclaimer, the term of this patent is extended or adjusted under 35 U.S.C. 154(b) by 0 days.

(21) Appl. No.: 13/937,174

(22) Filed: Jul. 8, 2013

(65) Prior Publication Data

US 2015/0007474 A1 Jan. 8, 2015

(51) Int. Cl.
*F41A 19/09* (2006.01)

(52) U.S. Cl.
CPC ..... *F41A 19/09* (2013.01)
USPC ..... 42/69.01

(58) Field of Classification Search
CPC ..... F41A 19/00; F41A 19/06; F41A 19/08; F41A 19/09
USPC ..... 42/1.11, 69.01, 69.02, 69.03; 89/136
See application file for complete search history.

(56) References Cited

U.S. PATENT DOCUMENTS 2,097,962 A * 11/1937 Boussel ..... 89/127
4,012,860 A * 3/1977 Auger ..... 42/94
4,718,187 A * 1/1988 Blake ..... 42/84
4,803,910 A * 2/1989 Troncoso ..... 89/27.3
5,220,116 A * 6/1993 Sheets ..... 42/94
5,272,955 A * 12/1993 Bond et al. ..... 89/37.04
5,954,507 A * 9/1999 Rod et al. ..... 434/19
6,164,002 A * 12/2000 Troncoso ..... 42/69.01
6,766,794 B1 * 7/2004 Bently ..... 124/35.2
2005/0066808 A1 * 3/2005 Hawkes et al. ..... 89/41.05
2006/0196098 A1 * 9/2006 Lee et al. ..... 42/123
2008/0115660 A1 * 5/2008 Hensel ..... 89/136
2011/0030544 A1 * 2/2011 Hodge ..... 89/41.05
2013/0145670 A1 * 6/2013 Kuhlman ..... 42/84

* cited by examiner

*Primary Examiner* — Bret Hayes

(57) ABSTRACT

This invention includes an adaptive mechanism for activating a firearm's trigger comprising a bite-activated trigger assembly, a cable assembly, an actuator assembly, lanyard, and a storage assembly. When properly assembled, the actuator is mated adjacent to the firearm's trigger in such a manner that the actuator is not exerting a force significant enough to activate the firearm's trigger. One end of the cable assembly is attached to a bite trigger assembly. The bite trigger assembly includes two bite plates that are pivotally joined together near the centerline of the bite plates. The bite trigger assembly also includes a feature to mount with the lanyard assembly. Finally the bite-activated trigger assembly includes a storage assembly that is used to stow the bite trigger assembly when the firearm is not in use.

18 Claims, 5 Drawing Sheets a)

b)
Firearm without the present invention shown

TRIGGER MECHANISM

FIELD OF THE INVENTION

This invention relates generally to the field of firearms, and specifically an adaptive device for activating a firearm's trigger.

BACKGROUND OF THE INVENTION

Mankind has used firearms for hunting, self-defense, law enforcement, and military purposes since the inception of firearms as early as the 14$^{th}$ Century. In many locations, including the United States of America, the right to bear arms is a protected individual right. For example, the Second Amendment of the United States Constitution delineates, "the right of the people to keep and bear arms shall not be infringed." Firearms are just as important in modern times as they have ever been.

The fundamental design of most firearms includes a stock, barrel, magazine for storing and loading bullets, and a trigger mechanism. Most firearms are designed to fire, or discharge bullets, with a finger-activated trigger. Persons with physical impairments, such as a lack of physical dexterity in the hands or fingers, may not be able to operate a finger-activated trigger. In addition, some people may prefer to operate a firearm with a non-finger activated trigger to improve the user experience including to avoid trigger burn, or to improve shooting accuracy. Thus, there is a need for a non-finger activated trigger mechanism to adapt the use of firearms for persons with physical impairments and to improve the user experience.

This invention provides a novel solution for a non-finger activated trigger mechanism including an ergonomic bite plate assembly, a spring-tensioned cable, a rod actuator assembly, a lanyard system with a quick-disconnect feature for holding the bite plate assembly for easy access, and a storage feature for safely storing the bite plate assembly when the firearm is not in use.

BRIEF SUMMARY OF THE INVENTION

One embodiment of the invention is an adaptive mechanism for activating a firearm's trigger comprising a bite-activated trigger assembly, a cable assembly, an actuator assembly, and a storage assembly. First, the firearm's trigger is modified to include an actuator assembly, which includes support plates and an actuator. One end of the actuator is pivotally attached to a first support plate. A second support plate includes a mating feature to accept the opposite end of the actuator. The opposite end of the actuator includes a mating feature to join one end of a cable assembly, referred to as the cable assembly's firearm-end. The cable assembly includes an adjustable spring that is used to push the actuator so the actuator's static position is not engaged with the firearm's trigger. The first and second support plates are placed on separate sides of the firearm's trigger. The first and second support plates are fastened together on each side of the firearm's trigger using fasteners, such as screws. When properly assembled, the actuator assembly is mated adjacent to the firearm's trigger in such a manner that the actuator is not exerting a force significant enough to activate the firearm's trigger.

Next, the opposite end of the cable assembly, referred to as the bite-trigger end, is attached to the bite trigger assembly. The cable assembly is designed such that the overall length of cable assembly is sufficient to attach the cable's firearm end to the actuator and the bite-trigger end to the bite trigger, and sufficient to enable the operator to use the firearm. The overall length of cable assembly is also optimized such that the cable will be pulled when the operator bites down on the bite trigger assembly enough to activate the firearm's trigger with the actuator. The overall length of the cable assembly may be optimized for specific firearm types, or the overall length of the cable assembly may be designed to work with a wide variety of firearms.

The bite trigger assembly includes two bite plates that are pivotally joined together near the centerline of the bite plates. The bite trigger assembly also includes a spring. The spring is attached to the bite plates and designed to hold the two bite plates substantially parallel to each other during the static position. The end of the bite trigger assembly opposite to where the cable assembly is attached may include a mouth guard. The mouth guard may include two separate pieces of compressible material, such as a soft polymer, each attached to a bite plate. A safety feature may also be included in the bite trigger assembly at the end of the bite trigger assembly opposite to where the cable assembly is attached. The safety feature is designed to prevent an accidental discharge of the firearm. The safety feature is designed such that the operator is able to disengage the safety feature with the use of the mouth or tongue. The bite trigger assembly also includes a feature to mount with the lanyard assembly.

Next, the bite-activated trigger assembly includes a lanyard that is used to attach the bite trigger assembly at times when the operator is not ready to activate the firearm's trigger. The lanyard consists of a quick disconnect mounting feature attached to a rope lanyard, such as a nylon rope. The lanyard's quick disconnect mounting feature mates with the bite trigger assembly's lanyard mounting feature. The lanyards' quick disconnect mounting feature is designed to allow the operator to disconnect the bite trigger assembly using a biting action, or other hands-free activated quick disconnect feature.

Finally the bite-activated trigger assembly includes a storage assembly that is used to stow the bite trigger assembly when the firearm is not in use. The storage assembly includes a housing designed to mate the entire bite trigger assembly. The housing includes side walls designed to protect the bite trigger assembly from being accidentally activated while the bite-activated trigger assembly is not in use. For example, the housing may be formed from at least three side walls with an opening designed to fit the bite trigger assembly within. One of the side walls includes a bite trigger assembly mating feature to mate with the bite trigger assembly's mating feature. The storage assembly also includes a mounting feature designed to enable the mounting feature to attach to the firearm.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION OF THE INVENTION

The following describes the details of the invention. Although the following description will proceed with reference being made to illustrative embodiments, many alternatives, modifications, and variations thereof will be apparent to those skilled in the art. Accordingly, it is intended that the claimed subject matter be viewed broadly. Examples are provided as reference and should not be construed as limiting. The term "such as" when used should be interpreted as "such as, but not limited to."

The invention provides a novel solution for modifying an existing firearm for use by operators with physical impairments, such as a lack of physical dexterity in the hands or fingers, that prevent the operator from using a finger-activated trigger. The invention is also applicable to operators that prefer to operate a firearm with a non-finger activated trigger to improve the user experience including to avoid trigger burn, or to improve shooting accuracy.

Figure 1:
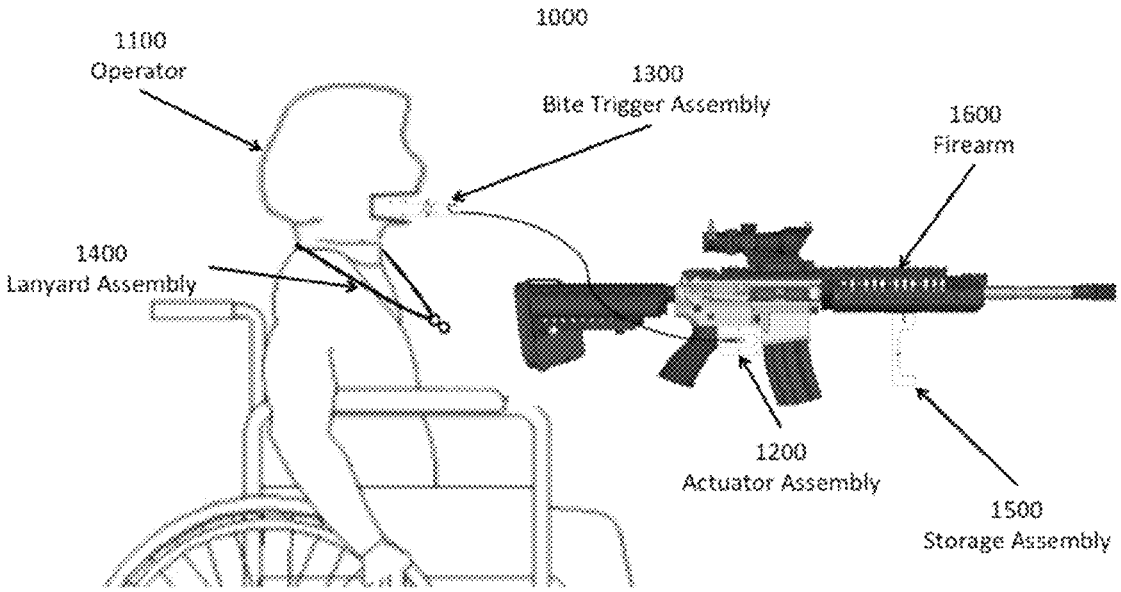
FIG. 1 is a diagram of an exemplary embodiment illustrating a system for activating a firearm's trigger using a non-finger activated trigger in accordance with the teachings of the present invention.
Figure 1:
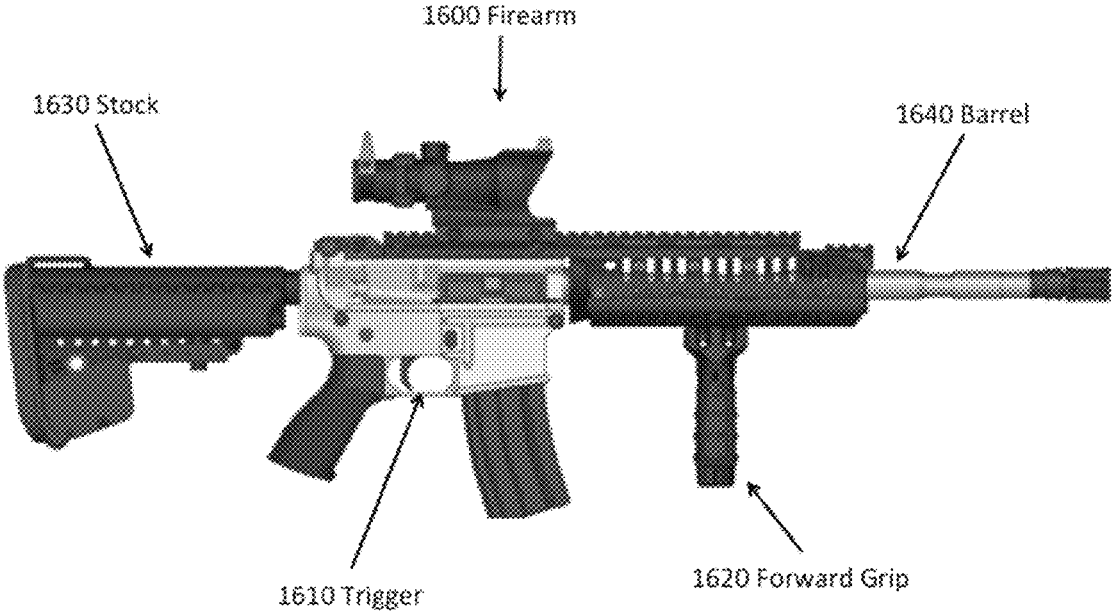
Figure 2:
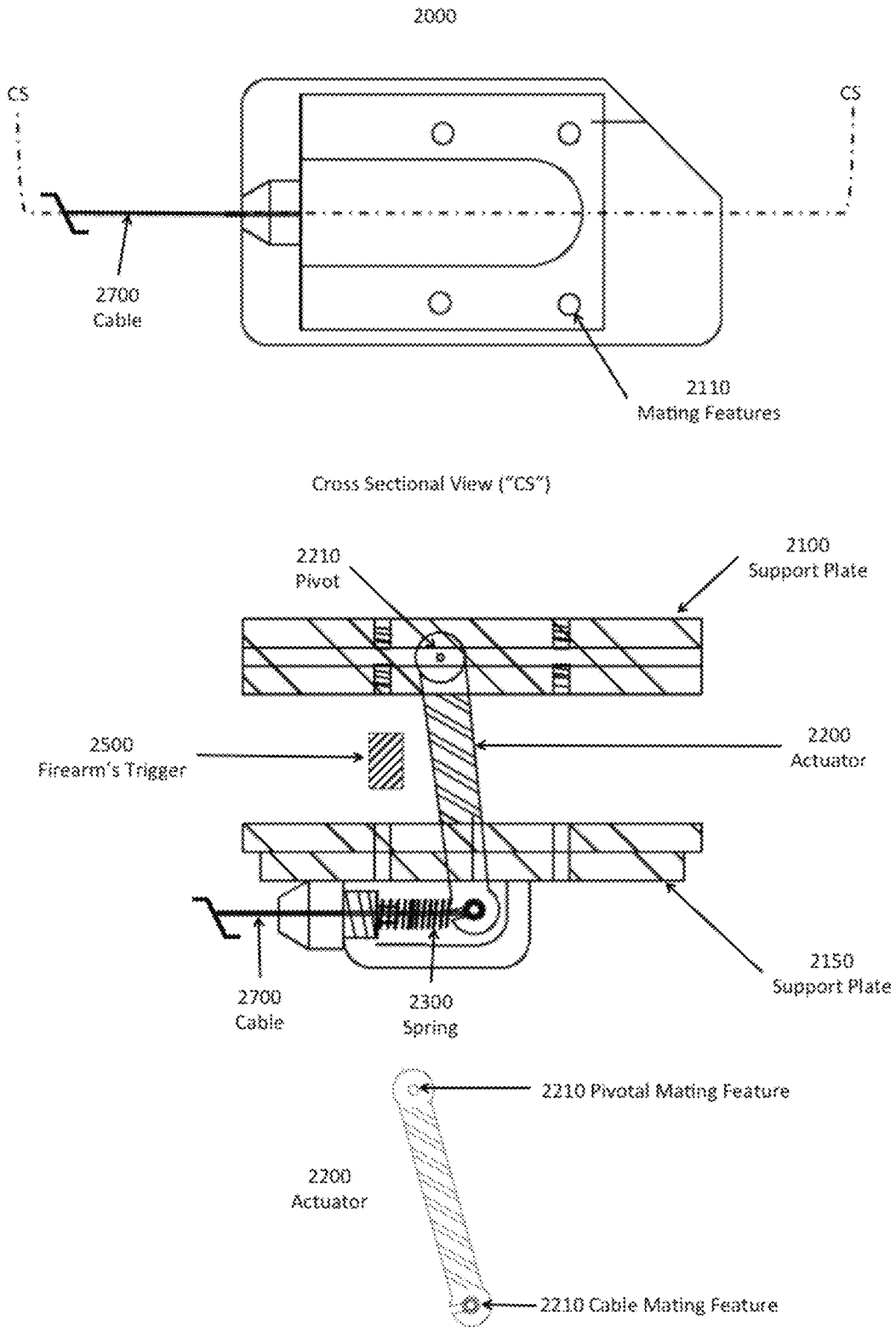
FIG. 2 is a diagram of an exemplary embodiment illustrating an actuator assembly in accordance with the teachings of the present invention.

FIG. 1 is a diagram of an exemplary embodiment for a system 1000 for activating a firearm's trigger 1610 comprising a bite trigger assembly 1300, a cable assembly 1700, an actuator assembly 1200, and a storage assembly 1500. First, the firearm's trigger 1610 is modified to include an actuator assembly 2000 (referring to FIG. 2), which includes support plates 2100 and an actuator 2200. One end of the actuator 2200 is pivotally attached to a first support plate 2210. The actuator 2200 may be made from a solid metal, composite, plastic, or other structurally rigid material. The geometry of the actuator 2200 is optimized to fit within the trigger well 1610 (referring to FIG. 1) of the firearm 1600. Ideally, the geometry is sized so that an actuator design could be used for several different firearm types. The actuator 2200 is attached to the first support plate 2100 in a manner that allows the actuator to pivot freely to engage with the firearm's trigger 2500 and pivot back into the static position, as shown in FIG. 2's Cross Sectional View. For example, the pivot end of the actuator 2210 may include a through hole with a similar through hole in the support plate. A fastener, such as a cotter pin or screw, may be inserted into the through holes to hold the actuator 2200 to the support plate 2100 while still allowing the actuator 2200 to pivot and engage the firearm's trigger 2500.

A second support plate 2150 includes a mating feature to accept the opposite end of the actuator. The mating feature may include a slot that allows the actuator 2200 to pivot and engage the firearm's trigger 2500, as well as pivot back to the static position.

The opposite end of the actuator 2200 includes a cable mating feature 2210 to join one end of the cable assembly, referred to as the cable assembly's firearm-end 2700. The cable assembly includes an adjustable spring 2300 that is used to push the actuator 2200 so the actuator's static position is not engaged with the firearm's trigger 2500 (as shown in FIG. 2). The spring 2300 may comprise a tension spring formed from a helical metal wire, or any other type of compressive material. The spring 2300 is designed such that the tensile load is sufficient enough to push the actuator 2200 away from the firearm's trigger 2500. The tensile load is also optimized such that the spring 2300 can be compressed when the operator 1100 (referring to FIG. 1) bites down on the bite trigger assembly 1300. The tensile load is again applied to the actuator 2200 when the operator 1100 stops biting down on the bite trigger assembly 1300, thus causing the actuator 2200 to be pushed away from the firearm's trigger 2500.

The first support plate 2100 and second support plate 2150 are placed on separate sides of the firearm's trigger 2500. The first support plate 2100 and second support plate 2150 are fastened together on each side of the firearm's trigger 2500 using fasteners, such as screws. When properly assembled, the actuator assembly 2000 is mated adjacent to the firearm's trigger 2500 in such a manner that the actuator 2200 is not exerting a force sufficient enough to activate the firearm's trigger 2500, as shown in FIG. 2.

The support plates may be formed from a single piece of material, or for ease of manufacturing, each support plate may be comprised of several thinner sheets that form the overall geometry of the support plate. This may be beneficial in allowing slots and mounting features to be included in the support plate to facilitate mating the actuator and mounting the support plates on to the firearm. The support plates may be made from metal, composite, wood, or any type of material sufficient to be fabricated with the geometric detail and support the associated forces and loads.

Figure 3:
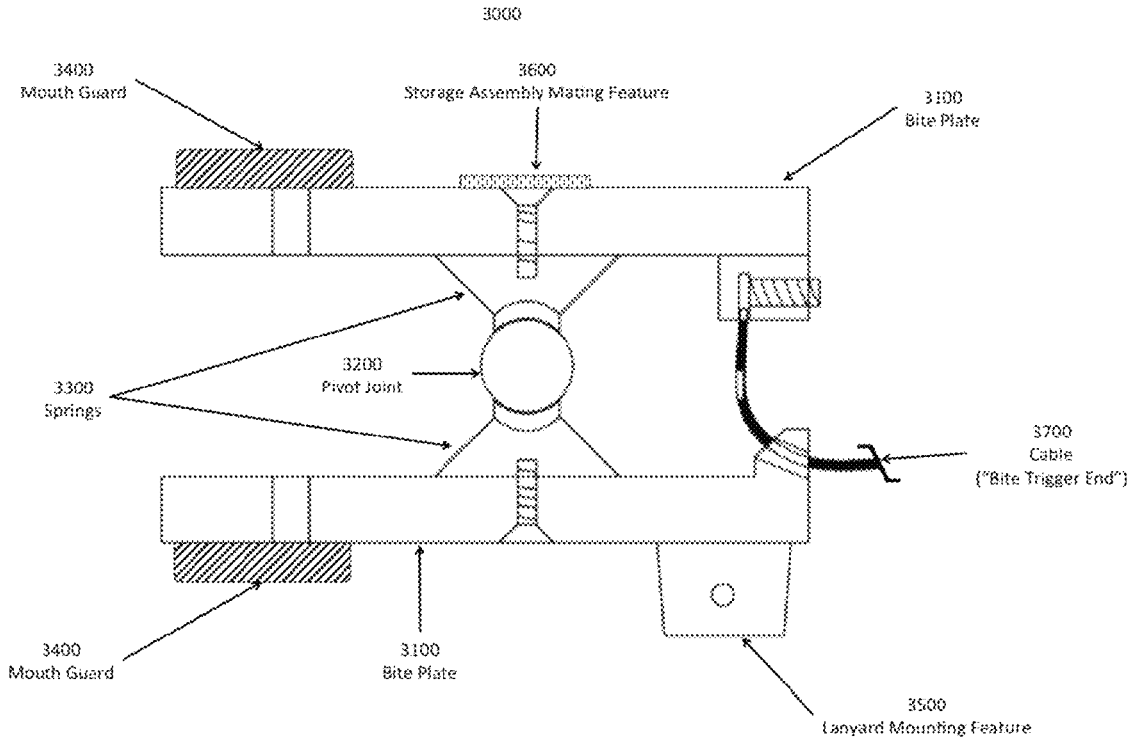
FIG. 3 is a diagram of an exemplary embodiment illustrating a bite trigger assembly in accordance with the teachings of the present invention.

Next, the opposite end of the cable assembly, referred to as the bite-trigger end 3700, is attached to the bite trigger assembly 3000 (referring to FIG. 3). The cable assembly 1700 is designed such that the overall length of cable assembly 1700 is sufficient to attach the cable's firearm end 2700 to the actuator 2200 and the bite-trigger end 3700 to the bite trigger assembly 3000, and sufficient to enable the operator 1100 to use the firearm 1600. The overall length of cable assembly 1700 is also optimized such that the cable assembly 1700 will be pulled when the operator 1100 bites down on the bite trigger assembly 1300 enough to activate the firearm's trigger with the actuator assembly 1200. The overall length of the cable assembly 1700 may be optimized for specific firearm types, or the overall length of the cable assembly 1700 may be designed to work with a wide variety of firearms. The ends of the cable are designed to attach to appropriate mating components using grommets, or other suitable cable fasteners common in cable systems.

The cable assembly 1700 may be comprised of several cable layers, such as a Bowden cable assembly which is commonly used in mechanical systems as a flexible cable used to transmit mechanical force by the movement of an inner cable relative to a hollow outer cable housing. The inner cable is typically composed of steel braided wires. The housing is generally made of a composite construction including a helical steel wire, lined with nylon, and with a plastic outer sheath. The linear movement of the inner cable is used to transmit a pulling force. For example, when the operator 1100 bites down on the bite trigger assembly 1300, the inner cable transmits the pulling force needed to pull the actuator 2200 toward the firearm's trigger 2500 enough to activate the firearm's trigger 2500. The cable assembly 1700 may also include provisions for adjusting the cable tension using an inline hollow bolt, such as a barrel adjuster, which lengthens or shortens the cable housing relative to a fixed anchor point. For adjustment purposes, lengthening the housing tightens the cable and shortening the housing loosens the cable.

The bite trigger assembly 3000 includes two bite plates 3100 that are pivotally joined 3200 together near the centerline of the bite plates 3100. The bite plates 3100 may be formed from a single piece of material, or for ease of manufacturing, each bite plate 3100 may be comprised of several thinner sheets that form the overall geometry of the bite plate 3100. This may be beneficial in allowing slots and mounting features to be included in the bite plate 3100. The bite plates 3100 may be made from metal, composite, wood, or any type of material sufficient to be fabricated with the geometric detail and support the associated forces and loads. The bite plates 3100 also include features to help guide the cable and to clamp the end of the cable assembly 3700.

The bite trigger assembly 3000 also includes a spring 3300. The spring 3300 is attached to the each bite plate 3100 and designed to hold the two bite plates 3100 substantially parallel to each other during the static position, as shown in FIG. 3. The spring 3300 may be comprised of torsion springs placed between the two bite plates 3100 and designed such that the bite plates 3100 are held substantially parallel to each other when the operator 1100 is not applying a biting force to the bite plate assembly 3000. The spring 3300 may be fabricated from a helical metal coil wire. The spring 3300 may also be formed from a compressive spring, such as a compressive spring formed from a helical metal coil wire, or a compressive foam material. More than one spring 3300 may be used to provide a broader range of spring loads, such as using multiple springs with different spring constants in parallel. Additionally springs may be placed at both ends of the bite trigger assembly to better position the bite plates 3100 parallel to each other during the static position.

The end of the bite trigger assembly 3000 opposite to where the cable assembly 3700 is attached may include a mouth guard 3400. The mouth guard 3400 may include two separate pieces of compressible material, such as a soft polymer, each attached to a bite plate 3100. The mouth guard 3400 is designed to provide the operator 1100 a tooth-friendly surface to bite down on the bite trigger assembly 3000. The mouth guard 3400 is needed because the bite plates 3100 may be comprised of a solid material such as metal, composite, or hard plastics. The mouth guard 3400 pieces are attached to the bite plates 3100 sufficiently such that the mouth guard 3400 pieces do not easily become detached from the bite plates 3100. For example, the mouth guard 3400 pieces may be attached to the bite plates 3100 using a permanent, or semi permanent epoxy, cement, glue, adhesive tape, fastener, or a grommet may be included in the mouth guard's geometry that is pushed into a mating through hole in the bite plates 3100.

A safety feature may also be included in the bite trigger assembly 3000 at the end of the bite trigger assembly opposite to where the cable assembly is attached. The safety feature is designed to prevent an accidental discharge of the firearm. The safety feature is designed such that the operator is able to disengage the safety feature with the use of the mouth or tongue.

The bite trigger assembly also includes a lanyard mounting feature 3500 to mount with the lanyard assembly. The lanyard mounting feature 3500 may include a through hole in the bite plate designed to allow a clip to connect to the through hole.

Next, the system 3000 includes a lanyard assembly 4000 (referring to FIG. 4) that is used to attach the bite trigger assembly 4500 at times when the operator 4100 is not ready to activate the firearm's trigger. The lanyard assembly 4000 consists of a quick disconnect mounting feature 4300 attached to rope 4200, such as a nylon rope. The lanyard's quick disconnect mounting feature 4300 mates with the bite trigger assembly's lanyard mounting feature 3500. The lanyards' quick disconnect mounting feature 4300 is designed to allow the operator 4100 to disconnect the bite trigger assembly 4500 using a biting action, or other hands-free activated quick disconnect feature. Alternatively, commercial-over-the-shelf lanyards may be used including models with quick disconnect clips.

Figure 5:
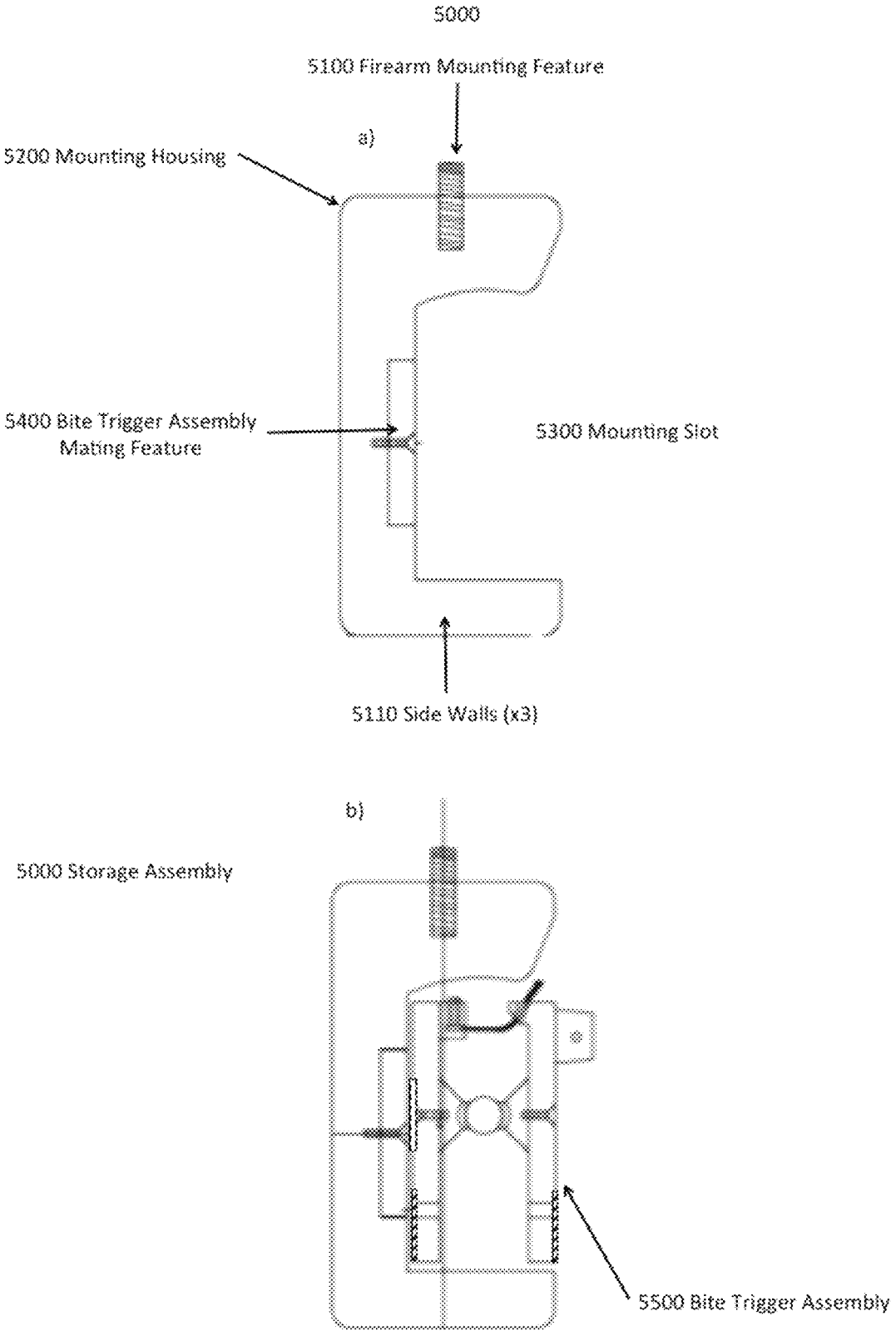
FIG. 5 is a diagram of an exemplary embodiment illustrating a storage assembly in accordance with the teachings of the present invention.

Finally the system includes a storage assembly 5000 that is used to stow the bite trigger assembly 5500 when the firearm is not in use. The storage assembly 5000 includes a mounting housing designed 5200 to stow the entire bite trigger assembly 5200, as shown in FIG. 5 b. The mounting housing 5200 includes side walls 5110 designed to protect the bite trigger assembly from being accidentally activated while the bite-activated trigger assembly is not in use. For example, the mounting housing 5200 may be formed from at least three side walls 5110 with a mounting slot 5300 designed to fit the bite trigger assembly within. One of the side walls may include a bite trigger assembly mating feature 5400 to mate with the bite trigger assembly's storage assembly mating feature 3600. The bite trigger assembly mating feature 5400 may be formed from a geometry suitable for mating such as a dove tail joint (with the opposite mating dove tail joint included in the bite trigger assembly), fabric hook-and-loop fastener (with the opposite mating hook-and-loop fastener included on the bite trigger assembly), or a magnetic faster (with the opposite mating magnet included on the bite trigger assembly).

The storage assembly 5000 also includes a firearm mounting feature 5100 designed to enable the mounting feature to attach to the firearm. For example the firearm's forward grip 1620 may be replaced with the storage assembly 5000 using the appropriate type of mating fastener required to mate with the firearm, such as a threaded post on the storage assembly that screws into the mating threaded slot on the firearm. The storage assembly 5000 may also be attached to firearm accessory mounts such as a Picatinny rail, MIL-STD-1913 rail, STANAG 2324 rail, Weaver rail, or tactical rail, which are brackets used on some firearms to provide a standardized mounting platform for accessories and attachments.

Figure 4:
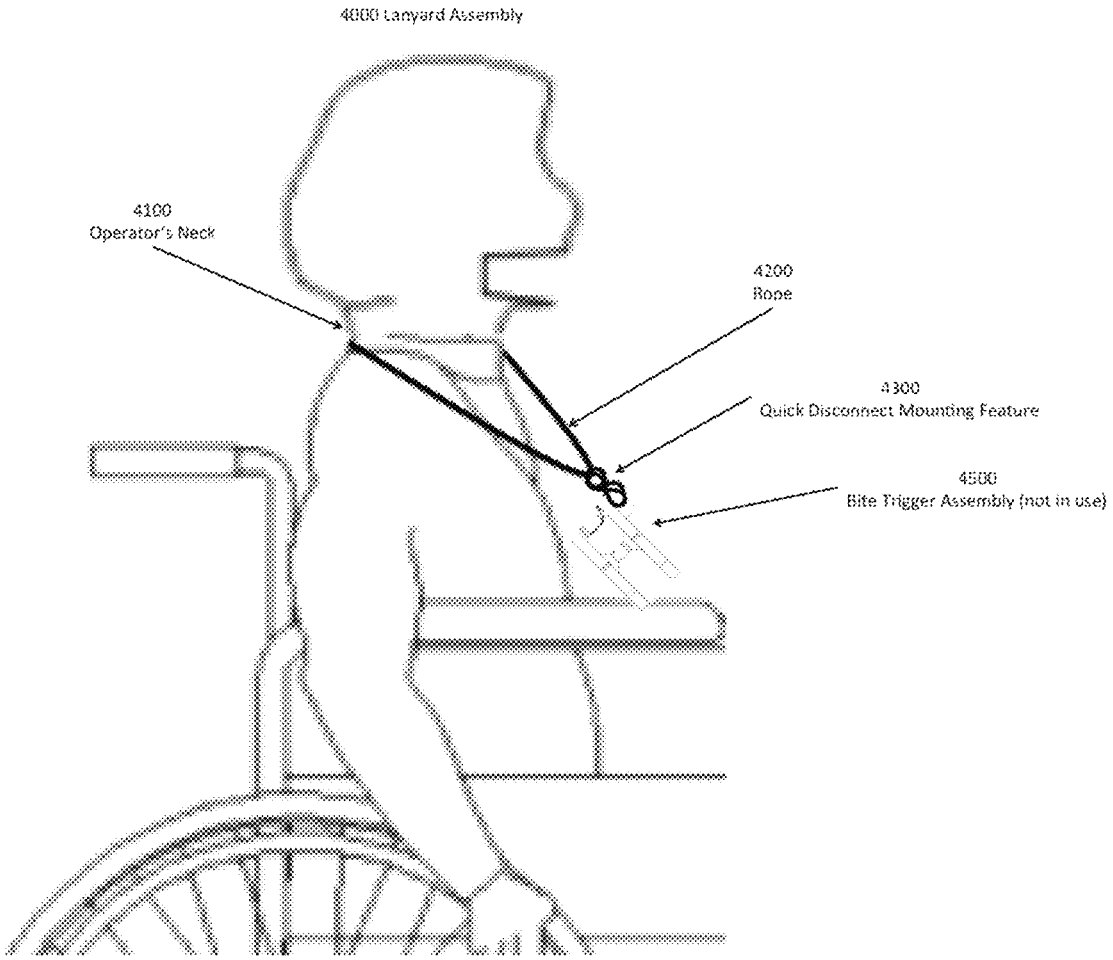
FIG. 4 is a diagram of an exemplary embodiment illustrating a lanyard assembly in accordance with the teachings of the present invention.

The invention enables the operator 1100 to activate the firearm's trigger 1610 by biting down on the bite trigger assembly 1300. Biting on the bite trigger assembly 1300 causes the cable assembly 1700 to be pulled, which in turn pulls the actuator 2200 within the actuator assembly 1200 enough to activate the firearm's trigger 1610. When the operator 1100 stops biting on the bite trigger assembly 1300, the actuator assembly's spring 2300 pushes the actuator 2200 back to the static position. In the static position, the actuator 2200 does not exert enough force to activate the firearm's trigger 2500. The operator 1100 can repeat the process repeatedly to continue activating the firearm's trigger 2500 to discharge the firearm 1600. When the operator 1100 is not intending to activate the firearm's trigger 1610, the operator 1100 can stow the bite trigger assembly 4500 on the lanyard assembly 4000 (as shown in FIG. 4). And when the operator 1100 is again ready to activate the firearm's trigger 1610, the operator 1100 can easily retrieve the bite trigger assembly 1300 from the lanyard assembly 1400. The operator 1100 can stow the bite trigger assembly 1300 within the storage assembly 1500 when the firearm 1600 is placed in storage. The invention is also designed to attach to an existing firearm, and the design of the invention may be standardized to fit on many different firearm types.

The terms and expressions, which have been employed herein, are used as terms of description and not of limitation, and there is no intention, in the use of such terms and expressions, of excluding any equivalents of the features shown and described (or portions thereof), and it is recognized that various modifications are possible within the scope of the claims.

Other modifications, variations, and alternatives are also possible. Accordingly, the claims are intended to cover all such equivalents.

What is claimed is:

1. A non-finger activated trigger assembly comprising:

an actuator assembly attached to an exterior of a trigger guard mechanism on a firearm;

a bite-activated trigger assembly;

a mechanical pull cable assembly positioned at an exterior of the firearm;

a lanyard;

and a storage assembly with a compartment designed to hold the entirety of bite-activated trigger assembly when the firearm is not in use; and wherein the actuator assembly comprises at least a first support plate and a second support plate, with the first support plate attached to a side of the trigger guard, the side accessing a trigger, and the second support plate attached to an opposite side of the trigger guard, and an actuator with an end of the actuator pivotally attached to the first support plate, such that a free end of the actuator pivots freely to engage the trigger and pivot back into a static position.

2. The assembly of claim 1, wherein the actuator assembly is mated adjacent to the trigger guard in such a manner that the free end of the actuator is not exerting a force sufficient to activate the trigger.

3. The assembly of claim 1, wherein the second support plate includes a mating feature to accept the free end of the actuator including a slot that allows the actuator to pivot and engage the trigger, as well as pivot back to the static position.

4. The assembly of claim 1, wherein the free end of the actuator includes a mating feature to attach an end of the mechanical pull cable assembly.

5. The assembly of claim 1, wherein the actuator assembly is standardized to be used for several different firearm types.

6. The assembly of claim 1, wherein the cable assembly includes a spring designed such that the spring exerts a force sufficient to push the actuator away from the trigger when the operator is not biting down on the bite-activated trigger assembly and the force exerted by the spring is also optimized such that the spring can be compressed when the operator bites down on the bite-activated trigger assembly.

7. The assembly of claim 1, wherein a bite-activated trigger assembly end of the cable assembly is attached to the bite-activated trigger assembly with an overall length optimized such that an inner cable within the mechanical pull cable assembly will be pulled when the operator bites down on the bite-activated trigger assembly enough to activate the trigger with the actuator.

8. The assembly of claim 1, wherein the mechanical pull cable assembly comprises a Bowden cable assembly with an inner cable transmitting a pulling force sufficient to pull the actuator toward the trigger enough to activate the trigger when the operator bites down on the bite-activated trigger assembly.

9. The assembly of claim 1, wherein the bite-activated trigger assembly comprises a first bite plate and a second bite plate that are joined together near the centerline of the first bite plate and the second bite plate by a pivot joint, wherein the first bite plate and second bite plate rotate about the pivot joint when the operator bites down on the bite-activated trigger assembly causing an end of the bite-activated trigger assembly where the mechanical pull cable assembly is attached to expand and pull an inner cable of the mechanical pull cable assembly enough to activate an actuator of the actuator assembly, and a spring attached to the first bite plate and the second bite plate to hold the first bite plate and the second bite plate substantially parallel to each other during a static position.

10. The assembly of claim 9, wherein an end of the bite-activated trigger assembly opposite to an end where the mechanical pull cable assembly is attached includes a mouth guard to provide the operator a tooth-friendly surface to bite down on the bite-activated trigger assembly.

11. The assembly of claim 9, wherein a safety feature is included on the bite-activated trigger assembly that the operator is able to disengage with a mouth or a tongue of the operator prior to discharging the firearm.

12. The assembly of claim 9, wherein the bite-activated trigger assembly includes a mounting feature to mount to the lanyard assembly, wherein the mounting feature includes a through hole in the first bite plate or the second bite plate, and the mounting feature is further designed to allow a clip to connect to the through hole.

13. The assembly of claim 1, wherein the lanyard assembly includes a quick disconnect clip that can be clipped and unclipped when the operator bites the quick disconnect clip.

14. The assembly of claim 1, wherein the storage assembly includes a bite trigger assembly mating feature to mate with a mating feature on the bite-activated trigger assembly.

15. The assembly of claim 14, wherein the bite trigger assembly mating feature comprises a magnetic faster.

16. The assembly of claim 1, wherein the storage assembly includes a mounting feature designed to enable the storage assembly to attach to the firearm by replacing a forward hand grip on the firearm with the storage assembly.

17. The assembly of claim 1, wherein the storage assembly is attached to an accessory mount on the firearm.

18. The assembly of claim 17, wherein the accessory mount comprises a Picatinny rail, MIL-STD-1913 rail, STANAG23234 rail, Weaver rail, or tactical rail.

* * * * *